US005183614A

United States Patent [19]

Champion

[11] Patent Number: 5,183,614

[45] **Date of Patent: * Feb. 2, 1993**

[54] METHOD FOR PRODUCING X-RAY DETECTABLE SPANDEX FIBERS

[75] Inventor: Allan R. Champion, Wilmington, Del.

[73] Assignee: E. I. Du Pont de Nemours and Company, Wilmington, Del.

[ * ] Notice: The portion of the term of this patent subsequent to Jan. 2, 2009 has been disclaimed.

[21] Appl. No.: 301,470

[22] Filed: Jan. 26, 1989

[51] Int. Cl.[5] ..... D01F 6/70

[52] U.S. Cl. ..... 264/184; 264/205; 264/211

[58] Field of Search ..... 264/184, 205, 211

[56] References Cited

U.S. PATENT DOCUMENTS

| | | | |
|---|---|---|---|
| 3,388,200 | 6/1968 | Jackson et al. | 264/184 |
| 3,536,668 | 10/1970 | Wieder et al. | 264/184 |
| 3,708,453 | 1/1973 | Thoma et al. | 524/104 |
| 4,525,420 | 6/1985 | Imai et al. | 428/372 |

*Primary Examiner*—Leo B. Tentoni

[57] ABSTRACT

An X-ray detectable spandex fiber and a method for producing it from a segmented polyurethane polymer comprising finely divided X-ray detectable material such as barium sulfate.

9 Claims, No Drawings

METHOD FOR PRODUCING X-RAY DETECTABLE SPANDEX FIBERS

BACKGROUND OF THE INVENTION

1. Field of the Invention

This invention relates to spandex fibers which are detectable by means of X-ray and a method for producing them.

2. Description of the Prior Art

Spandex fibers made from long chain synthetic polymers comprising at least 85% segmented polyurethanes are well known. Such spandex fibers have been found to be useful as retractile elements in the preparation of artificial ligaments for use in surgical replacement therapy as described in U.S. Pat. No. 4,610,688 issued Sep. 9, 1986 on the application of Silvestrini et al. The use of an X-ray detectable spandex fiber would be advantageous in such applications so that the placement of an implanted ligament containing such fibers could be monitored by radiographic techniques.

There now has been discovered through the process of this invention an X-ray detectable spandex fiber that has the elongation and flex life required for artificial ligaments and other applications where these qualities of the spandex fiber must be retained.

U.S. Pat. No. 4,185,626 issued Jan. 29, 1980 on the application of Jones et al. discloses an X-ray detectable filament of an elastomeric, nonpolyurethane material. Jones et al. teaches that the filament incorporates throughout its length a continuous reinforcing thread as the filament is heavily loaded with an X-ray detectable filler which may give rise to breaks during stretching and may even permit the filler to disperse. A non toxic element of atomic weight above 100, or one of its compounds such as barium sulfate is disclosed by Jones et al. as an X-ray opaque filler material.

SUMMARY OF THE INVENTION

The present invention provides a process for producing an X-ray detectable spandex fiber comprising:

a) dissolving a long chain synthetic polymer comprising at least 85% segmented polyurethane, preferably a polyether polyurethane, in an organic solvent, preferably dimethylacetamide, to form a polymer spinning solution;

b) blending an effective amount of a finely divided X-ray opaque filler material comprising an element of atomic number of at least 20, preferably barium sulfate, into the polymer spinning solution before forming the fiber, preferably in a quantity sufficient to provide at least 25% filler material by weight of the total polymer and filler material and more preferably, about 40–55% filler material by weight of the total polymer and filler material;

c) wet spinning or air gap spinning fibers from the polymer solution/X-ray opaque filler material blend, if air gap spinning is used, an air gap of 20–75mm is preferred;

d) passing the fibers through an aqueous bath wherein the temperature of the bath is preferably maintained in the range from 45° C. to about 90° C. and more preferably from 60° to 70° C.

Further provided by this invention is an X-ray detectable spandex fiber which can be produced from the process of this invention.

Further provided by this invention is a spandex fiber with greater than 300% elongation and an effective amount of an X-ray opaque filler material comprising an element of atomic number of at least 20.

In accordance with a preferred form of the present invention, the fiber is a polyether polyurethane spandex having an average pore size less than 10 microns and comprises X-ray opaque filler material of at least 25% by weight of total solids and more preferably, about 40–55% by weight of total solids. In a preferred embodiment of the fiber of this invention, the X-ray opaque filler material is barium sulfate.

DETAILED DESCRIPTION OF THE INVENTION

In accordance with the present invention, filler material is included in the spandex fiber to render it detectable by X-rays. The term "effective amount" in the present application is intended to refer to the amount of X-ray detectable filler material necessary to render the spandex fiber X-ray opaque. The filler material must be, among other things, opaque to X-rays, capable of being sterilized and uniformly distributed throughout the fiber cross section. The amount of X-ray opaque filler material in the spandex fiber detectable by X-rays, can be varied over a fairly broad range. Generally, 25% X-ray opaque filler material by weight of total polymer and filler material should be present to be adequately detectable by X-ray. Concentrations of about 40–55% X-ray opaque filler by weight of total polymer and filler material yields a fiber with excellent marking properties.

Suitable X-ray opaque filler material can be any biocompatible material containing an element with an atomic number of at least 20 such as barium (56), iodine (53), titanium (22), or one of their compounds. Barium sulfate is preferred because of its relatively high atomic number which improves the X-ray absorption.

The X-ray opaque filler material, in accordance with the present invention, can be in the form of a finely divided powder. This permits a more homogenous distribution of the filler material in the fiber than could be obtained if the filler material particles were larger. Filler material with particles having an average size of less than 1.0 microns are preferred for ease and uniformity of dispersion in the fiber.

The X-ray detectable spandex fibers of the present invention are made from segmented polyurethane polymers, such as those based on polyethers, polyesters and the like. Polyurethanes which are flexible in nature and therefore suitable for forming the fibers of this invention are generically termed spandex. Spandex refers to fibers in which at least 85% of the fiber forming substance consists of segmented polyurethane. The spandex type polyurethanes are referred to as segmented because they consist of an alternate arrangement of soft segments consisting of either polyether or polyester blocks and hard segments that generally contain aromatic urea and sometimes urethane groups as the rigid components. The rigid segments are derived from the reaction of the isocyanates with urea-producing compounds. The production of polyurethanes is well known in the art, see for example U.S. Pat. No. 2,957,852 issued Oct. 25, 1960 on the application of Frankenberg et al. Generally, the process involves the reaction of an isocyanate and a second compound which contains an active hydrogen group such as hydroxyl, amino or carboxyl group. The procedure in the production of polyurethanes is to treat a hydroxy-terminated polyester or polyether polyol with a polyisocyanate to produce what is known as a prepolymer. This prepolymer is then dissolved in a solvent which is relatively inert to the reactants and an aliphatic diamine such as hydrazine is added to extend the polymer into the segmented structure suitable for the spandex fiber of this invention.

Polyether polyurethanes are preferred when preparing an X-ray detectable spandex fiber for use in artificial ligaments because spandex fibers with polyether soft segments have greater hydrolytic stability.

To make the X-ray detectable spandex fibers of this invention, the barium sulfate particles can be added at any of several points in the preparation of the spandex fibers. The process involves dissolving a segmented polyurethane polymer in an organic solvent, such as dimethyl acetamide, and then spinning the solution through orifices into fibers. Preferably, the barium sulfate is mixed into a slurry with the organic solvent and then blended into the polymer solution and homogenized to break up agglomerates before spinning. The barium sulfate particles could also be added separately to the polymer spinning solution, as a dry powder.

The polymer solution/X-ray opaque filler material mixture is then wet or air gap spun and coagulated in an aqueous bath to remove solvent. If air gap spinning is used, an air gap of 20–75mm is preferred. Surprisingly, dry spinning, the generally preferred method of producing spandex fibers, does not produce fibers suitable for use in this invention. During dry spinning, fibers were found to break due to the high loading of X-ray filler material.

Preferably the temperature of the aqueous bath is maintained in the range of 45° C. to 90° C. and more preferably 60° C. to 70° C. to optimize the desired physical properties of the spandex fiber of this invention for ligament use, of low porosity, high tenacity and high percent elongation. Room temperature baths yield fibers with greatly increased pore sizes, some pores greater than 300 microns, which results in a reduction in the elongation and tenacity of the fiber as well as permitting bacteria to enter the fiber rendering it less suitable for use in implantation.

In addition to the X-ray detectable filler material, spandex filaments of the invention may also contain additives for other purposes, such as delusterants, antioxidants, pigments, stabilizers against heat, light and fumes and the like.

The X-ray detectable spandex fiber of this invention does not suffer from a significant reduction in percent elongation compared with spandex fibers without filler. Additionally, the spandex fiber tenacity, which decreases on addition of X-ray opaque filler material, can be improved by drawing the fibers of this invention at, for example, 180° C. to twice the length, just as fibers without filler are drawn to improve tenacity.

The X-ray detectable spandex fiber of this invention has an elongation greater than 300%, comprises an effective amount of an X-ray opaque filler material and preferably average pore sizes of less than 10 microns. The X-ray opaque filler material comprises an element of atomic number of at least 20, preferably barium sulfate, and is at least 25% by weight of total solids and preferably 40–55%. The fiber diameter is typically 0.5 to 2mm and is dependent on the spinning speed and air gap used.

Test Methods

The following test procedures are used for measuring the various parameters discussed herein:

Elongation and Tenacity

Elongation and tenacity of the spandex fibers are measured by stretching single fibers to failure in a standard Instron test machine. A Gauge length of two inches and a strain rate of 1000% per minute are customarily used. Breaking force is measured by a standard load cell, and elongation at break is determined from the load versus deflection curve produced by the test machine.

Pore Size

Pore size is determined by scanning electron microscopy (SEM) of fiber cross sections. Magnifications of 150X to 1500X are customarily employed.

DESCRIPTION OF THE PREFERRED EMBODIMENTS EXAMPLE

A spinning mixture of barium sulfate and a polyether polyurethane spandex polymer was prepared and fibers spun from it as described below. Barium sulfate powder (Sachtleben Chemie, W. Germany) having an average particle diameter of 0.2 micron was wetted with dimethylacetamide to form a slurry. This slurry was added to a solution of 36% polyether polyurethane solids in dimethyl acetamide with 0.5% "Santowhite" powder (Trademark of Monsanto for 1,1-bis(2-methyl-4-hydroxy-5-t-butylphenyl)butane) as an antioxidant and was blended using a disc stirrer for three hours. The amounts of barium sulfate and spandex in the mix were adjusted to give a final composition of 21% spandex, 26% barium sulfate and 53% dimethylacetamide solvent by weight. This mixture was then homogenized in a gear pump to break up agglomerates of barium sulfate.

50 cc of the barium sulfate spandex blend were placed in a syringe pump and passed through a 200 mesh screen pack to remove any remaining agglomerates, extruded as a filament through a spinneret, across a 70 mm air gap and into a bath of distilled water maintained at 70° C. After exiting the bath, the filament was passed into a cold water bath. The filament diameter was approximately 0.7 mm. Pore size was 1 to 3 microns in the inner one-third of the fiber cross-section. The outer two-thirds of the fiber cross-section had essentially no pores greater than 1 micron.

The filament was then boiled in distilled water for one hour to remove any remaining dimethylacetamide solvent. The filament was allowed to dry in air and was then placed in a vacuum oven at 70° C. overnight and wound onto a bobbin for further use. The final filament diameter was 0.5–0.6 mm and barium sulfate was 55% by weight. The filament properties were measured to be 0.14 grams per denier tenacity and 415% elongation.

A sample of this filament was wound on a human femur bone and exposed to X radiation at 100 ma, 48 KV, for 0.1 sec. and 100 ma, 64 KV, for 0.05 sec. and demonstrated excellent contrast to the bone. Animal implants have shown that this filament allows an artificial ligament incorporating several strands of the filament to be observed easily under X-radiation.

I claim:

1. A process of producing an X-ray detectable spandex fiber comprising:

a) dissolving a long chain synthetic polymer comprising at least 85% segmented polyurethane in an organic solvent to form a polymer spinning solution;

b) blending a finely divided X-ray opaque filler material comprising an element of atomic number of at lest 20 into the polymer spinning solution before forming the fiber, wherein the amount of X-ray opaque filler material is at least 25% by weight of the total polymer and filler material;

c) air gap spinning fibers from the polymer solution/X-ray opaque filler material blend; and d) passing the fibers through an aqueous bath.

2. The process of claim 1 wherein the X-ray opaque filler material is about 40–50% by weight of the total polymer and filler material.

3. The process of claim 1 or 2, wherein the X-ray opaque filler material is barium sulfate.

4. The process of claim 1 wherein the temperature of the aqueous bath is 45° C. to 90° C.

5. The process of claim 1 wherein the temperature of the aqueous bath is 60° C. to 70° C.

6. The process of claim 1 wherein the fibers are air gap spun with an air gap in the range from 20 mm to 75 mm.

7. The process of claim 1 wherein a slurry is formed of the X-ray opaque filler material in a portion of the solvent and then the slurry is mixed with the polymer solution of step (a).

8. The process of claim 1 wherein the organic solvent is dimethylacetamide.

9. The process of claim 1 wherein the polymer is a polyether polyurethane spandex polymer.

* * * * *